US010118194B2

(12) United States Patent
Kobayashi et al.

(10) Patent No.: US 10,118,194 B2
(45) Date of Patent: Nov. 6, 2018

(54) SLURRY APPLICATION DEVICE AND SLURRY APPLICATION METHOD

(71) Applicant: JFE STEEL CORPORATION, Tokyo (JP)

(72) Inventors: Hirokazu Kobayashi, Tokyo (JP); Yushi Harada, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 0 days.

(21) Appl. No.: 15/507,925

(22) PCT Filed: Sep. 2, 2015

(86) PCT No.: PCT/JP2015/074971

§ 371 (c)(1),
(2) Date: Mar. 1, 2017

(87) PCT Pub. No.: WO2016/035825

PCT Pub. Date: Mar. 10, 2016

(65) Prior Publication Data

US 2017/0282206 A1 Oct. 5, 2017

(30) Foreign Application Priority Data

Sep. 5, 2014 (JP) ..... 2014-181634

(51) Int. Cl.

| | |
|---|---|
| ***B05C 11/02*** | (2006.01) |
| ***B05C 11/06*** | (2006.01) |
| ***B05D 3/12*** | (2006.01) |
| ***B05D 7/24*** | (2006.01) |
| ***B05D 1/28*** | (2006.01) |
| ***B05D 3/00*** | (2006.01) |
| ***B05C 1/08*** | (2006.01) |
| ***B05C 11/10*** | (2006.01) |
| *B05B 1/14* | (2006.01) |
| *B05B 13/02* | (2006.01) |
| *B05C 9/04* | (2006.01) |

(52) U.S. Cl.

CPC ..... *B05D 3/12* (2013.01); *B05C 1/08* (2013.01); *B05C 11/025* (2013.01); *B05C 11/06* (2013.01); *B05C 11/1005* (2013.01); *B05D 1/28* (2013.01); *B05D 3/00* (2013.01); *B05D 7/24* (2013.01); *B05B 1/14* (2013.01); *B05B 13/0221* (2013.01); *B05C 9/04* (2013.01); *B05D 2252/02* (2013.01)

(58) Field of Classification Search

CPC .. B05C 1/08; B05C 11/06; B05D 1/28; B05D 3/00; B05D 3/12; B05D 2252/02

See application file for complete search history.

(56) References Cited

U.S. PATENT DOCUMENTS

| | | | |
|---|---|---|---|
| 2,823,641 A | 2/1958 | Cook et al. | |
| 3,987,750 A | 10/1976 | Knapke | |
| 4,559,900 A | 12/1985 | Knapke et al. | |

FOREIGN PATENT DOCUMENTS

| | | | | |
|---|---|---|---|---|
| JP | 63286521 | A | | 11/1988 |
| JP | 3004151 | B2 | | 1/2000 |
| JP | 2002-66424 | A | * | 3/2002 |
| JP | 2002066424 | A | | 3/2002 |
| JP | 2013-180270 | A | * | 9/2013 |
| JP | 2013-188743 | A | * | 9/2013 |
| JP | 2013180270 | A | | 9/2013 |
| JP | 2013188743 | A | | 9/2013 |

OTHER PUBLICATIONS

International Search Report and Written Opinion for International Application No. PCT/JP2015/074971, dated Dec. 8, 2015, 6 pages.
Japanese Office Action for Japanese Application No. 2014-181634, dated May 9, 2017, including Concise Statement of Relevance of Office Action, 3 pages.
Extended European Search Report for European Application No. 15838372.9, dated Apr. 24, 2018, 9 pages.
Chinese Office Action for Chinese Application No. 201580046536.X, dated Jun. 28, 2018 with English Search Report, 9 pages.
Korean Office Action for Korean Application No. 2017-7005155, dated Jun. 27, 2018 with Concise Statement of Relevance, 6 pages.

* cited by examiner

*Primary Examiner* — William P Fletcher, III
(74) *Attorney, Agent, or Firm* — RatnerPrestia

(57) ABSTRACT

A slurry application device includes: a slurry supply unit configured to supply slurry to a surface of a traveling base material; a slurry application unit including a first roll body disposed at the downstream side in relation to the slurry supply unit and configured to press the first roll body against the slurry to apply the slurry onto the surface and to adjust an adhesion amount of the slurry such that a film thickness of the slurry becomes one time or more and two times or less of a target film thickness; and a slurry adhesion amount adjustment unit including a second roll body disposed at the downstream side in relation to the slurry application unit and configured to press the second roll body against the slurry to adjust the slurry adhesion amount such that the film thickness of the slurry becomes the target film thickness.

10 Claims, 5 Drawing Sheets

SLURRY APPLICATION DEVICE AND SLURRY APPLICATION METHOD

CROSS REFERENCE TO RELATED APPLICATIONS

This is the U.S. National Phase application of PCT International Application No. PCT/JP2015/074971, filed Sep. 2, 2015, and claims priority to Japanese Patent Application No. 2014-181634, filed Sep. 5, 2014, the disclosures of these applications being incorporated herein by reference in their entireties for all purposes.

FIELD OF THE INVENTION

The present invention relates to a slurry application device and a slurry application method for applying slurry onto a surface of a base material.

BACKGROUND OF THE INVENTION

Recently, a surface treatment of forming various coating films on a surface of a base material has been performed in order to give characteristics of corrosion resistance, workability, a beautiful appearance, and an insulation property to a base material such as a steel plate. In general, in the surface treatment for the base material, application liquid of slurry including solid particles of a ceramics element is sequentially supplied to the continuously traveling base material and then the supplied slurry is applied onto the surface of the base material by a roll applicator. As a result, a film of the slurry is formed as the coating film of the surface of the base material.

The roll applicator is a device which presses a roll rotating about an axis in a width direction of a base material (hereinafter, appropriately referred to as a material width direction) against slurry supplied to the surface of the base material and applies the slurry onto the surface of the base material by a pressing load of the roll to form a film (a coating film) of the slurry. As the roll applicator, for example, a double roll applicator which applies slurry onto each surface of the base material by using two rolls or a triple roll applicator which applies slurry onto each surface of the base material by using three rolls has been widely used. As particular advantages of the triple roll applicator, a coating film thickness of the slurry can be excellently controlled and a relatively beautiful surface of the film of the slurry can be obtained by the triple roll applicator. However, since maintenance of the roll applicator or process management becomes complex in accordance with an increase in the number of the rolls of the roll applicator, a production cost of the base material applied by the slurry increases. Thus, a single roll applicator which applies slurry by using one roll for each surface of the base material has been widely used in recent years.

As described above, a type which applies slurry onto the surface of the base material by using the roll applicator (hereinafter, referred to as a roll applicator type) can be effectively used to adjust an adhesion amount of slurry forming a coating film on the surface of the base material by squeezing an extra amount of the slurry excessively supplied to the surface of the base material in advance from the surface of the base material by a pressing load of the roll. As such a roll applicator type, a rubber roll having a groove carved in an outer circumferential surface may be used as the roll of the roll applicator in order to ensure a necessary adhesion amount of the slurry of the surface of the base material.

Meanwhile, in a method of supplying slurry to the surface of the base material, since a problem arises in that slurry nozzles are clogged, it is difficult to uniformly supply the slurry in the material width direction by using slit nozzles. For this reason, a method of supplying slurry to the surface of the base material by using a plurality of spray nozzles arranged in the width direction of the base material can be employed. However, even in this method, since the slurry cannot be easily uniformly supplied to the surface of the base material in the material width direction, the slurry is not uniformly supplied in the material width direction. In this case, the slurry unevenly remains on the surface of the base material even after the slurry is squeezed by the roll applicator.

Further, as a representative application defect in a slurry application process in the roll applicator type, there is known a stripe-shaped appearance defect called ribbing and occurring in a roll outer circumferential direction of the roll applicator. The ribbing is known as a defect occurring when a change in fluid pressure of a liquid meniscus between rolls of the roll applicator or between the roll and the surface of the base material (hereinafter, simply referred to as "between a roll and a base material") exceeds a surface tension stabilization effect. Such ribbing easily occurs in accordance with an increase in amount (the liquid amount of slurry) of the liquid meniscus between the roll and the base material.

Additionally, as a related art of applying slurry onto the surface of the base material while suppressing an application defect such as ribbing and uneven application, for example, there is known a method of adjusting a slurry application amount (an adhesion amount) of the surface of the base material by ejecting a gas from slit nozzles to the surface of the base material in an inclined direction after applying slurry onto the surface of the base material (see Patent Literature 1). Further, there is known a method of adjusting an adhesion amount of slurry supplied to the surface of the base material by a roll applicator and adjusting the adhesion amount of the slurry again by ejecting a gas to the slurry of the surface of the base material using a gas wiping device (see Patent Literature 2).

CITATION LIST

Patent Literature

Patent Literature 1: Japanese Laid-open Patent Publication No. 63-286521

Patent Literature 2: Japanese Patent No. 3004151

SUMMARY OF THE INVENTION

Incidentally, the base material applied with slurry cannot contact a conveying roll until the slurry is completely dried. For this reason, there is provided a suspension zone in which the base material is suspended within a travel path (a conveying path) of the base material. A vibration easily occurs in the base material traveling in the suspension zone.

As disclosed in Patent Literatures 1 and 2, in a case where a gas is ejected to the slurry of the surface of the base material to adjust a final adhesion amount of the slurry, a distance between the gas ejection nozzle and the surface of the base material changes due to a vibration of the base material in the suspension zone. As a result, since the gas ejection nozzle ejects a gas to the surface of the base material at an unintended near position, the slurry of the surface of the base material is scattered by the ejected gas. Further, a base material travel speed (hereinafter, referred to as a line speed) may decrease due to a process performed on the base material at the upstream side (the entrance side) or the downstream side (the exit side) in the base material travel direction in relation to the gas ejection nozzle. In this case, since a pressure of the gas ejected from the gas ejection nozzle to the surface of the base material is not adjusted in accordance with a change in line speed, a force of wiping the slurry by the ejected gas can be large too much and thus the slurry of the surface of the base material is scattered. The scattering of the slurry damages a beautiful appearance of the slurry of the surface of the base material. As a result, it is difficult to maintain a beautiful appearance of the slurry in the entire length of the base material.

Aspects of the present invention are made in view of the above-described circumstances and an object of these aspects of the present invention is to provide a slurry application device and a slurry application method capable of forming a uniform film of slurry on a surface of a base material in an entire length of the base material and suppressing an appearance defect in the film of the slurry of the surface of the base material.

To solve the above-described problem and achieve the object, a slurry application device according to aspects of the present invention includes: a slurry supply unit configured to supply slurry to a surface of a traveling base material; a slurry application unit including a first roll body disposed at the downstream side in a travel direction of the base material in relation to the slurry supply unit and configured to press the first roll body against the slurry supplied to the surface of the base material to apply the slurry onto the surface of the base material and to adjust an adhesion amount of the slurry applied on and adhering to the surface of the base material such that a film thickness of the slurry of the surface of the base material becomes one time or more and two times or less of a target film thickness; and a slurry adhesion amount adjustment unit including a second roll body disposed at the downstream side in the travel direction of the base material in relation to the slurry application unit and configured to press the second roll body against the slurry applied on the surface of the base material to adjust the slurry adhesion amount such that the film thickness of the slurry on the surface of the base material becomes the target film thickness.

Moreover, in the slurry application device according to aspects of the present invention, the second roll body is a groove attachment rubber roll whose outer circumferential surface is provided with a plurality of grooves arranged in a width direction of the base material and inclined with respect to the travel direction of the base material, and the groove attachment rubber roll adjusts the slurry adhesion amount in such a manner that the outer circumferential surface provided with the plurality of grooves is pressed against the slurry of the surface of the base material.

Moreover, in the slurry application device according to aspects of the present invention, the plurality of grooves are formed such that an angle of 15° to 75° is formed with respect to the travel direction of the base material.

Moreover, in the slurry application device according to aspects of the present invention, rotation directions of the first roll body and the second roll body are same as the travel direction of the base material at contact portions of the first roll body and the second roll body with respect to the slurry of the surface of the base material.

Moreover, the slurry application device according to aspects of the present invention further includes a gas ejection unit configured to level an outer surface of the slurry without changing the slurry adhesion amount by ejecting a gas to the slurry whose adhesion amount is adjusted by the slurry adhesion amount adjustment unit.

Moreover, a slurry application method according to aspects of the present invention includes: a slurry supply step of supplying slurry onto a surface of a traveling base material; a slurry application step of pressing a first roll body disposed at the downstream side in a travel direction of the base material in relation to a slurry supply unit supplying the slurry against the slurry supplied to the surface of the base material to apply the slurry onto the surface of the base material and to adjust an adhesion amount of the slurry applied on and adhering to the surface of the base material such that a film thickness of the slurry of the surface of the base material becomes one time or more and two times or less of a target film thickness; and a slurry adhesion amount adjustment step of pressing a second roll body disposed at the downstream side in the travel direction of the base material in relation to a slurry application unit applying the slurry against the slurry applied on the surface of the base material to adjust the slurry adhesion amount such that the film thickness of the slurry on the surface of the base material becomes the target film thickness.

Moreover, in the above-described slurry application method according to aspects of the present invention, the slurry adhesion amount adjustment step adjusts the slurry adhesion amount by pressing an outer circumferential surface of the second roll body serving as a groove attachment rubber roll whose outer circumferential surface is provided with a plurality of grooves arranged in a width direction of the base material and inclined with respect to the travel direction of the base material against the slurry of the surface of the base material.

Moreover, in the above-described slurry application method according to aspects of the present invention, the plurality of grooves are formed such that an angle of 15° to 75° is formed with respect to the travel direction of the base material.

Moreover, in the above-described slurry application method according to aspects of the present invention, rotation directions of the first roll body and the second roll body are same as the travel direction of the base material at contact portions of the first roll body and the second roll body with respect to the slurry of the surface of the base material.

Moreover, the above-described slurry application method according to aspects of the present invention further includes a gas ejection step of leveling an outer surface of the slurry without changing the slurry adhesion amount by ejecting a gas to the slurry of which the adhesion amount is adjusted by the slurry adhesion amount adjustment step.

According to aspects of the invention, there is an effect that a uniform film of slurry can be formed on a surface of a base material in an entire length of the base material and an appearance defect of the film of the slurry on the surface of the base material can be suppressed.

DETAILED DESCRIPTION OF EMBODIMENTS OF THE INVENTION

Figure 1:
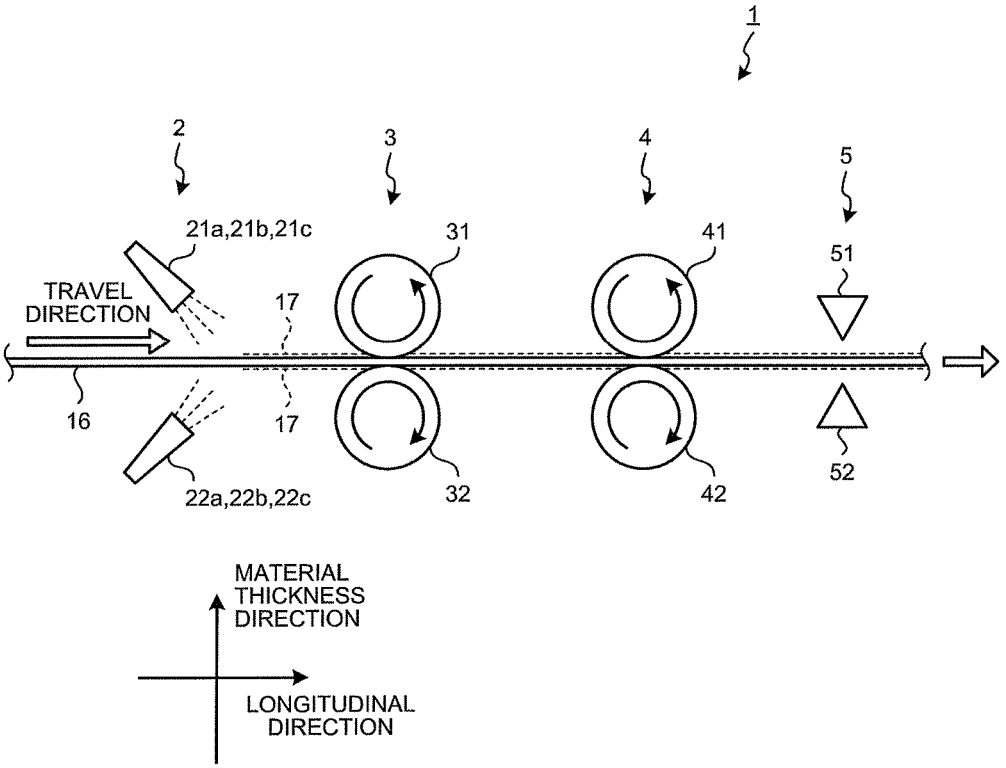
FIG. 1 is a diagram illustrating a configuration example of a slurry application device according to an embodiment of the invention.

Hereinafter, preferred embodiments of a slurry application device and a slurry application method according to aspects of the invention will be described in detail with reference to the accompanying drawings. Additionally, in the embodiment, the slurry application device and the slurry application method according to aspects of the invention will be described by exemplifying a belt-shaped steel plate (a steel strip) as an example of a base material corresponding to a target of a surface treatment of applying slurry onto a base material surface, but the invention is not limited by the embodiment. Further, the drawings are schematically illustrated and a case where a dimensional relation between components and scales of components are different from those of real components needs to be considered. Even in the drawings, a dimensional relation or a scale may be different from each other. Further, in the drawings, the same reference numerals are given to the same components.

(Configuration of Slurry Application Device)

Figure 2:
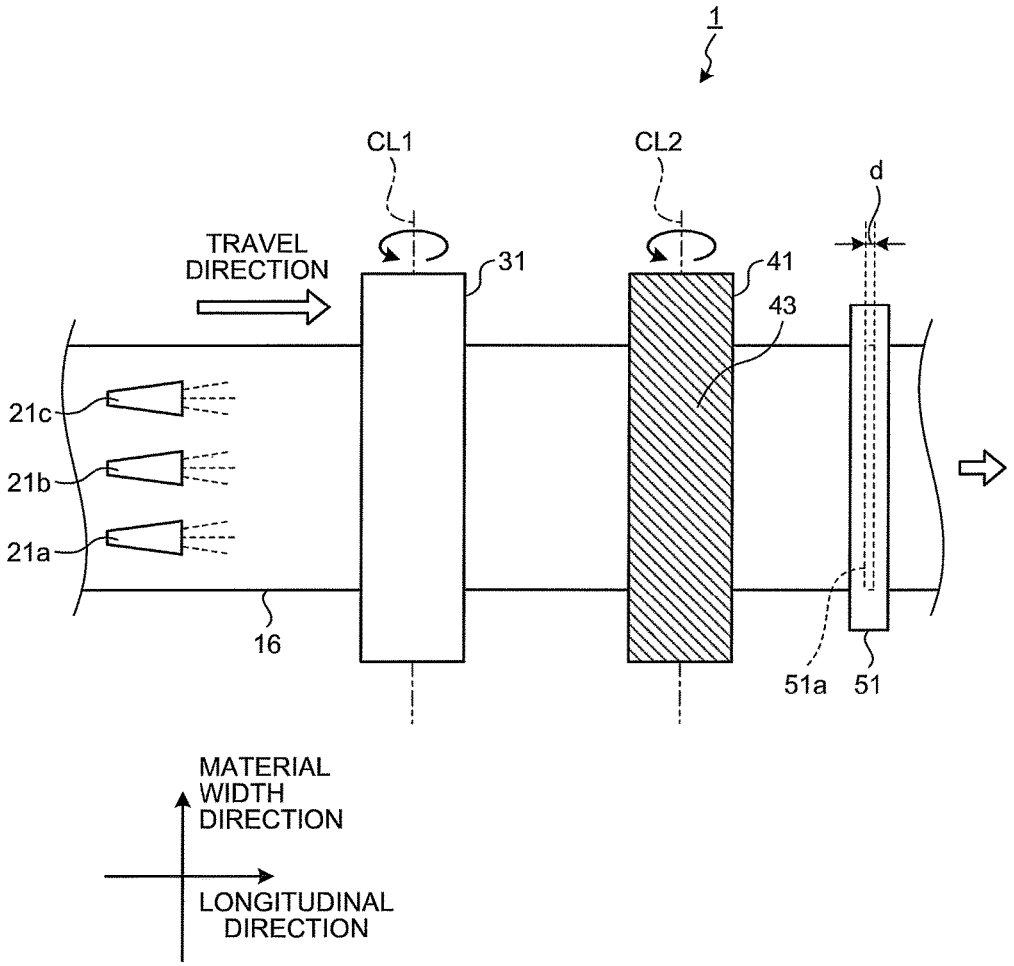
FIG. 2 is a diagram illustrating the slurry application device illustrated in FIG. 1 when viewed from above.

First, a configuration of a slurry application device according to the embodiment of the invention will be described. FIG. 1 is a diagram illustrating a configuration example of the slurry application device according to the embodiment of the invention. FIG. 2 is a diagram illustrating the slurry application device illustrated in FIG. 1 when viewed from above. Additionally, in FIG. 2, slurry on a steel strip surface is not illustrated in order to easily describe components of the slurry application device.

As illustrated in FIGS. 1 and 2, a slurry application device 1 according to the embodiment includes a slurry supply unit 2 which supplies slurry 17 to a steel strip 16 and a slurry application unit 3 which applies the slurry 17 onto the steel strip 16. Further, the slurry application device 1 includes an adhesion amount adjustment unit 4 which finally adjusts an adhesion amount of the slurry 17 adhering to the steel strip 16 and a gas ejection unit 5 which ejects a gas in order to level an outer surface of the slurry 17 after an adhesion amount is adjusted. The slurry supply unit 2, the slurry application unit 3, the adhesion amount adjustment unit 4, and the gas ejection unit 5 are disposed along a travel path of the steel strip 16. Specifically, as illustrated in FIG. 1, the slurry supply unit 2, the slurry application unit 3, the adhesion amount adjustment unit 4, and the gas ejection unit 5 are disposed in this order in the travel direction (see a bold arrow of FIG. 1) of the steel strip 16.

Additionally, in the embodiment, the steel strip 16 sequentially and continuously travels in a direction from an entrance side of the slurry supply unit 2 toward an exit side of the gas ejection unit 5 as indicated by the bold arrow of FIG. 1. The travel direction of the steel strip 16 is the same as the longitudinal direction of the steel strip 16. A thickness direction (hereinafter, appropriately referred to as a material thickness direction) of the steel strip 16 is the same as the vertical direction of the slurry application device 1. The material width direction of the steel strip 16 is a direction perpendicular to the travel direction and the material thickness direction of the steel strip 16.

The slurry supply unit 2 is used to supply the slurry 17 onto the surface of the continuously traveling steel strip 16 and includes upper supply nozzles 21*a* to 21*c* and lower supply nozzles 22*a* to 22*c* as illustrated in FIGS. 1 and 2. Each of the upper supply nozzles 21*a* to 21*c* and the lower supply nozzles 22*a* to 22*c* is configured as, for example, a spray nozzle or the like and is connected to a pipe (not illustrated) circulating the slurry 17 therethrough. As illustrated in FIGS. 1 and 2, the upper supply nozzles 21*a* to 21*c* are arranged in the material width direction above the steel strip 16 and are disposed such that ejection openings face the front surface of the steel strip 16. As illustrated in FIG. 1, the lower supply nozzles 22*a* to 22*c* are disposed below the steel strip 16 such that ejection openings face the rear surface of the steel strip 16. Further, the lower supply nozzles 22*a* to 22*c* are arranged side by side in the material width direction of the steel strip 16 similarly to the upper supply nozzles 21*a* to 21*c* illustrated in FIG. 2.

The slurry supply unit 2 with the above-described configuration supplies the slurry 17 to the front surface of the steel strip 16 by using the upper supply nozzles 21*a* to 21*c* and supplies the slurry 17 to the rear surface of the steel strip 16 by using the lower supply nozzles 22*a* to 22*c*. In the embodiment, the front surface (the upper surface) of the steel strip 16 is a surface directed to the upside of the steel strip 16 and the rear surface (the lower surface) of the steel strip 16 is a surface directed to the downside of the steel strip 16. In this way, as the slurry 17 supplied to the front and rear surfaces of the steel strip 16, for example, slurry (specifically, an annealing separating agent or the like) including a ceramics element of magnesium oxide as solid particles is exemplified.

Additionally, the upper supply nozzles 21*a* to 21*c* and the lower supply nozzles 22*a* to 22*c* are not limited to the spray nozzles, but may be slit nozzles or the like as long as the slurry 17 can be supplied to the steel strip 16. In the embodiment, the spray nozzles are appropriately used as the upper supply nozzles 21*a* to 21*c* and the lower supply nozzles 22*a* to 22*c* from the viewpoint of easiness of supplying the slurry 17 to the steel strip 16. In this case, it is desirable that each of the spray nozzles respectively constituting the upper supply nozzles 21*a* to 21*c* and the lower supply nozzles 22*a* to 22*c* have a hole diameter $\phi$ of 3 [mm] or more in order to prevent nozzle clogging due to the slurry 17.

The slurry application unit 3 is a single roll applicator which applies the slurry 17 onto the surface of the steel strip 16 and adjusts the adhesion amount of the slurry 17 on the surface of the steel strip 16 by a roll applicator type. Specifically, as illustrated in FIG. 1, the slurry application unit 3 includes rubber rolls 31 and 32 which serve as first roll bodies disposed at the downstream side of the travel direction of the steel strip 16 in relation to the slurry supply unit 2.

As illustrated in FIGS. 1 and 2, the rubber roll 31 is a roll body which rotates about a roll shaft CL1 in the material width direction of the steel strip 16 and includes at least a rubber layer forming an outer circumferential surface. The rubber roll 31 is disposed above the steel strip 16 to contact the front surface of the steel strip 16 while applying a predetermined pressure thereto. Similarly to the upper rubber roll 31, the rubber roll 32 is a roll body which rotates about a roll shaft (not illustrated) in the material width direction of the steel strip 16 and includes at least a rubber layer forming an outer circumferential surface. As illustrated in FIG. 1, the rubber roll 32 is disposed below the steel strip 16 to contact the rear surface of the steel strip 16 while applying a predetermined pressure thereto. As illustrated in FIG. 1, the rubber rolls 31 and 32 respectively press the slurries 17 on both front and rear surfaces of the steel strip 16 by sandwiching the steel strip 16 from both sides in the material thickness direction while rotating in the outer circumferential direction. Further, as illustrated in FIG. 1, the rotation directions of the rubber rolls 31 and 32 are the same as the travel direction of the steel strip 16 at the contact portions of the rubber rolls 31 and 32 with respect to the slurries 17 on the front and rear surfaces of the steel strip 16.

The slurry application unit 3 presses the upper rubber roll 31 against the slurry 17 supplied to the front surface of the steel strip 16 such that the slurry 17 is applied onto the front surface of the steel strip 16 and an adhesion amount (hereinafter, appropriately referred to as a front surface adhesion amount) of the slurry 17 applied and adhering to the front surface of the steel strip 16 is adjusted. At this time, the slurry application unit 3 squeezes an extra amount of the slurry 17 from the front surface of the steel strip 16 by the rubber roll 31. Accordingly, the front surface adhesion amount of the slurry 17 is adjusted such that the wet film thickness of the slurry 17 on the front surface of the steel strip 16 becomes one time or more and two times or less of the target film thickness. Also, the slurry application unit 3 presses the rubber roll 32 below the slurry 17 supplied to the rear surface of the steel strip 16 such that the slurry 17 is applied onto the rear surface of the steel strip 16 and an adhesion amount (hereinafter, appropriately referred to as a rear surface adhesion amount) of the slurry 17 applied and adhering to the rear surface of the steel strip 16 is adjusted. At this time, the slurry application unit 3 squeezes an extra amount of the slurry 17 from the rear surface of the steel strip 16 by the rubber roll 32.

Accordingly, the rear surface adhesion amount of the slurry 17 is adjusted such that the wet film thickness of the slurry 17 on the rear surface of the steel strip 16 becomes one time or more and two times or less of the target film thickness.

Additionally, the wet film thickness is a film thickness in a state (a wet state) where the slurries 17 adhering to the front and rear surfaces of the steel strip 16 are not dried. The target film thickness is a target wet film thickness which is a final target of the slurries 17 on the front and rear surfaces of the steel strip 16.

The adhesion amount adjustment unit 4 is a single roll applicator which applies the slurry 17 and adjusts the adhesion amount by the roll applicator type and serves as a final slurry adhesion amount adjustment unit which adjusts the adhesion amount of the slurry 17 applied onto the surface of the steel strip 16. Specifically, as illustrated in FIG. 1, the adhesion amount adjustment unit 4 includes groove attachment rubber rolls 41 and 42 which serve as second roll bodies disposed at the downstream side in the travel direction of the steel strip 16 in relation to the slurry application unit 3.

As illustrated in FIGS. 1 and 2, the groove attachment rubber roll 41 is a roll body which rotates about a roll shaft CL2 in the material width direction of the steel strip 16 and includes at least a rubber layer forming an outer circumferential surface. The groove attachment rubber roll 41 is disposed above the steel strip 16 to contact the front surface of the steel strip 16 while applying a predetermined pressure thereto. Similarly to the upper groove attachment rubber roll 41, the groove attachment rubber roll 42 is a roll body which rotates about a roll shaft (not illustrated) in the material width direction of the steel strip 16 and includes at least a rubber layer forming an outer circumferential surface. As illustrated in FIG. 1, the groove attachment rubber roll 42 is disposed below the steel strip 16 to contact the rear surface of the steel strip 16 while applying a predetermined pressure thereto. As illustrated in FIG. 1, the groove attachment rubber rolls 41 and 42 nip the steel strip 16 from both upper and lower sides in the material thickness direction while rotating in the outer circumferential direction such that the slurries 17 on both front and rear surfaces of the steel strip 16 are pressed. Further, as illustrated in FIG. 1, the rotation directions of the groove attachment rubber rolls 41 and 42 are the same as the travel direction of the steel strip 16 at the contact portions of the groove attachment rubber rolls 41 and 42 with respect to the slurries 17 on the front and rear surfaces of the steel strip 16.

Figure 3:
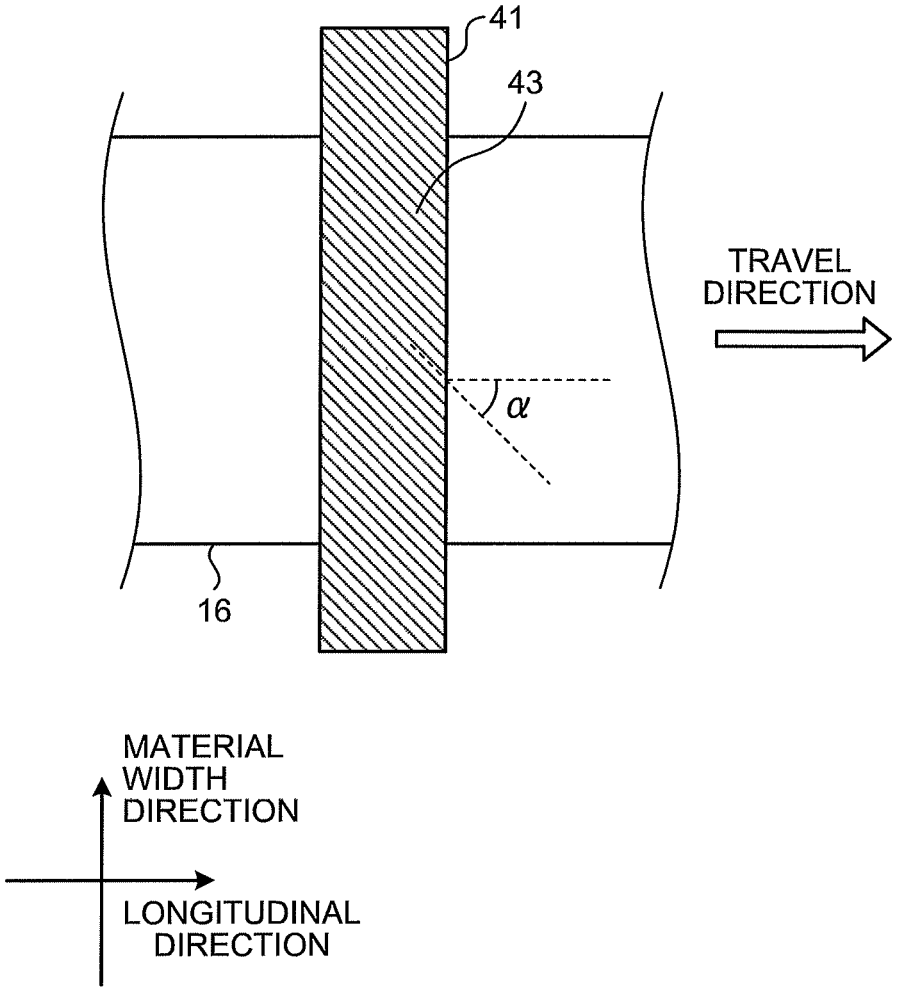
FIG. 3 is a diagram illustrating an example of a groove structure of a groove attachment rubber roll of the embodiment.

Further, as illustrated in FIG. 2, the outer circumferential surface of the groove attachment rubber roll 41 is provided with a plurality of grooves 43 having a shape inclined with respect to the travel direction of the steel strip 16 (an oblique line shape when viewed from the outer circumferential surface). FIG. 3 is a diagram illustrating an example of a groove structure of the groove attachment rubber roll of the embodiment. As illustrated in FIGS. 2 and 3, the groove attachment rubber roll 41 is a roll body provided with the plurality of grooves 43 inclined with respect to the travel direction of the steel strip 16 and arranged in the material width direction of the steel strip 16. As illustrated in FIG. 3, each of the plurality of grooves 43 is formed at the outer circumferential surface of the groove attachment rubber roll 41 such that an angle (hereinafter, referred to as a roll groove angle $\alpha$) of 15[°] or more and 75[°] or less is formed with respect to the travel direction of the steel strip 16.

In particular, although not illustrated in the drawings, the outer circumferential surface of the groove attachment rubber roll 42 is provided with a plurality of grooves inclined with respect to the travel direction of the steel strip 16 and arranged in the material width direction of the steel strip 16 similarly to the groove attachment rubber roll 41 illustrated in FIGS. 2 and 3. Similarly to each groove 43 of the groove attachment rubber roll 41 illustrated in FIG. 3, each groove of the groove attachment rubber roll 42 forms a roll groove angle $\alpha$ of 15[°] or more and 75[°] or less with respect to the travel direction of the steel strip 16.

The adhesion amount adjustment unit 4 presses the upper groove attachment rubber roll 41 against the slurry 17 applied onto the front surface of the steel strip 16 by the rubber roll 31 of the slurry application unit 3 to finally adjust the front surface adhesion amount of the slurry 17. At this time, the groove attachment rubber roll 41 presses the outer circumferential surface provided with the plurality of grooves 43 against the slurry 17 on the front surface of the steel strip 16 while rotating in the outer circumferential direction thereof. Accordingly, the groove attachment rubber roll 41 causes a liquid meniscus of the slurry 17 between the front surface of the steel strip 16 and the groove attachment rubber roll 41 along each groove 43. In this way, the groove attachment rubber roll 41 causes bubbles inside the slurry 17 and an extra amount of the front surface adhesion amount of the slurry 17 to flow in the material width direction such that the bubbles and the extra amount are squeezed from the front surface of the steel strip 16. Accordingly, the front surface adhesion amount of the slurry 17 is adjusted. The adhesion amount adjustment unit 4 finally adjusts the front surface adhesion amount of the slurry 17 such that the final wet film thickness of the slurry 17 on the front surface of the steel strip 16 becomes a target film thickness by the action of the groove attachment rubber roll 41.

Also, the adhesion amount adjustment unit 4 finally adjusts the rear surface adhesion amount of the slurry 17 by pressing the lower groove attachment rubber roll 42 against the slurry 17 applied onto the rear surface of the steel strip 16 by the rubber roll 32 of the slurry application unit 3. At this time, similarly to the upper groove attachment rubber roll 41, the groove attachment rubber roll 42 presses the outer circumferential surface provided with the plurality of grooves against the slurry 17 on the rear surface of the steel strip 16 while rotating in the outer circumferential direction thereof. Accordingly, the groove attachment rubber roll 42 causes a liquid meniscus of the slurry 17 between the rear surface of the steel strip 16 and the groove attachment rubber roll 42 along each groove. In this way, the groove attachment rubber roll 42 causes bubbles inside the slurry 17 and an extra amount of the rear surface adhesion amount of the slurry 17 to flow in the material width direction such that the bubbles and the extra amount are squeezed from the rear surface of the steel strip 16. Accordingly, the rear surface adhesion amount of the slurry 17 is adjusted. The adhesion amount adjustment unit 4 finally adjusts the rear surface adhesion amount of the slurry 17 such that the final wet film thickness of the slurry 17 on the rear surface of the steel strip 16 becomes the target film thickness by the action of the groove attachment rubber roll 42.

Additionally, the final wet film thickness is the final wet film thickness of the slurry 17 obtained after the adhesion amount of the slurry 17 (the front surface adhesion amount and the rear surface adhesion amount) applied by the slurry application unit 3 is adjusted again by the adhesion amount adjustment unit 4.

It is desirable that a rubber material used in each of the rubber rolls 31 and 32 of the slurry application unit 3 and the groove attachment rubber rolls 41 and 42 of the adhesion amount adjustment unit 4 be rubber having excellent wear resistance such as urethane rubber, nitrile rubber, and hypalon rubber. Further, it is desirable that each rubber hardness of the rubber rolls 31 and 32 and the groove attachment rubber rolls 41 and 42 be Shore A45 or more and Shore A85 or less. Meanwhile, it is desirable that each roll diameter of the rubber rolls 31 and 32 and the groove attachment rubber rolls 41 and 42 be 50 [mm] or more and 400 [mm] or less.

The gas ejection unit 5 ejects a gas to the slurry 17 of which the adhesion amount is finally adjusted by the adhesion amount adjustment unit 4 such that the outer surface of the slurry 17 is leveled without any change in adhesion amount of the slurry 17. Specifically, as illustrated in FIG. 1, the gas ejection unit 5 includes an upper gas ejection nozzle 51 and a lower gas ejection nozzle 52. Each of the upper gas ejection nozzle 51 and the lower gas ejection nozzle 52 is configured as, for example, a slit nozzle or the like and is connected to a pipe (not illustrated) circulating a gas such as air.

As illustrated in FIG. 2, the upper gas ejection nozzle 51 includes a slit-shaped ejection opening 51*a* which has a rectangular shape in the material width direction of the steel strip 16 and is disposed above the steel strip 16 to be appropriately separated from the front surface of the steel strip 16 such that the ejection opening 51*a* faces the slurry 17 on the front surface of the steel strip 16. It is desirable that the ejection opening 51*a* of the upper gas ejection nozzle 51 have a longitudinal dimension equal to or larger than the width of the steel strip 16 from the viewpoint of ejecting a gas to the slurry 17 on the front surface of the steel strip 16 to be uniform in the material width direction.

Further, as illustrated in FIG. 2, the upper gas ejection nozzle 51 includes a slit gap d serving as the opening width of the ejection opening 51*a*. It is desirable that the slit gap d of the ejection opening 51*a* be 0.3 [mm] or more and 4.0 [mm] or less and further 0.5 [mm] or more and 2.0 [mm] or less from the viewpoint of ejecting a gas having an appropriate pressure to the slurry 17 on the front surface of the steel strip 16.

A condition of the slit gap d is set as below. That is, when the slit gap d is smaller than 0.3 [mm], the amount of a gas ejected from the ejection opening 51*a* of the upper gas ejection nozzle 51 to the slurry 17 on the front surface of the steel strip 16 decreases. In this case, in order to obtain an effect of leveling the outer surface of the slurry 17 by a gas ejected from the upper gas ejection nozzle 51, there is a need to dispose the upper gas ejection nozzle 51 such that the ejection opening 51*a* is close to the front surface of the steel strip 16. As a result, since a risk of a contact between the upper gas ejection nozzle 51 and the steel strip 16 or the slurry 17 increases, a condition that the slit gap d is smaller than 0.3 [mm] is not desirable. Meanwhile, when the slit gap d exceeds 4.0 [mm], the amount of a gas ejected from the ejection opening 51*a* of the upper gas ejection nozzle 51 to the slurry 17 on the front surface of the steel strip 16 increases. In this case, since the upper gas ejection nozzle 51 ejects a gas capable of obtaining an effect of leveling the outer surface of the slurry 17 to the slurry 17 on the front surface of the steel strip 16, there is concern that the slurry 17 may be scattered. For this reason, a condition that the slit gap d exceeds 4.0 [mm] is not desirable.

Similarly to the upper gas ejection nozzle 51 illustrated in FIG. 2, the lower gas ejection nozzle 52 includes a slit-shaped ejection opening having a rectangular shape in the material width direction of the steel strip 16 and is disposed below the steel strip 16 to be appropriately separated from the rear surface of the steel strip 16 such that the ejection opening faces the slurry 17 on the rear surface of the steel strip 16 as illustrated in FIG. 1. In particular, although not illustrated in the drawings, the ejection opening of the lower gas ejection nozzle 52 includes a slit gap satisfying the same dimensional condition as that of the upper gas ejection nozzle 51. For example, as illustrated in FIG. 1, such a lower gas ejection nozzle 52 is disposed to face the upper gas ejection nozzle 51 with the steel strip 16 interposed therebetween.

The gas ejection unit 5 with the above-described configuration levels the slurry 17 on the front surface of the steel strip 16, that is, the outer surface of the slurry 17 of which the adhesion amount is finally adjusted by the groove attachment rubber roll 41 of the adhesion amount adjustment unit 4 by the action of the upper gas ejection nozzle 51. Accordingly, the gas ejection unit 5 beautifully finishes an appearance of the slurry 17 forming the film on the front surface of the steel strip 16. Also, the gas ejection unit 5 levels the slurry 17 on the rear surface of the steel strip 16, that is, the outer surface of the slurry 17 of which the adhesion amount is finally adjusted by the groove attachment rubber roll 42 of the adhesion amount adjustment unit 4 by the action of the lower gas ejection nozzle 52. Accordingly, the gas ejection unit 5 beautifully finishes an appearance of the slurry 17 forming the film on the rear surface of the steel strip 16.

(Slurry Application Method)

Figure 4:
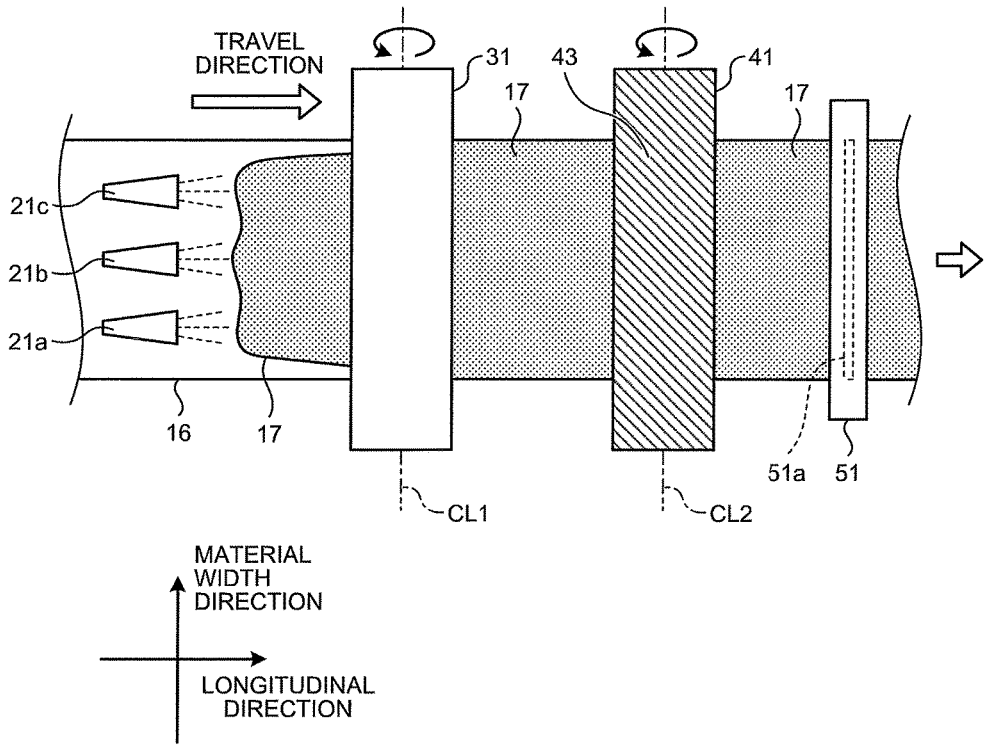
FIG. 4 is a diagram for describing a slurry application method according to the embodiment of the invention.
Figure 5:
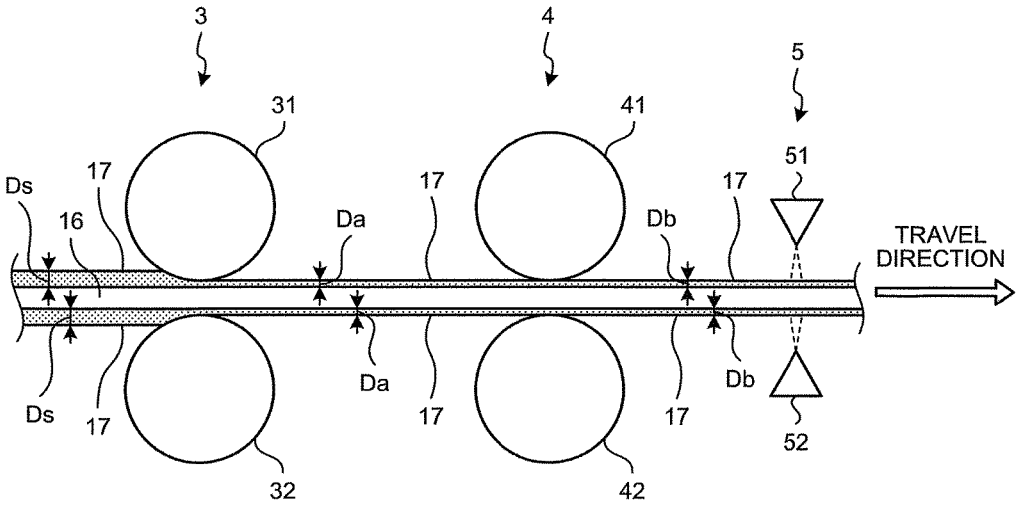
FIG. 5 is a diagram for describing a case where a slurry adhesion amount is adjusted by the slurry application method according to the embodiment of the invention.

Next, a slurry application method according to the embodiment of the invention will be described. FIG. 4 is a diagram for describing the slurry application method according to the embodiment of the invention. FIG. 5 is a diagram for describing a case where the slurry adhesion amount is adjusted by the slurry application method according to the embodiment of the invention. The slurry application method according to the embodiment of the invention is used to apply the slurry 17 onto each of the front and rear surfaces of the continuously traveling steel strip 16 and to adjust the adhesion amount of the slurry 17 such that the outer surface of the slurry 17 of each of the front and rear surfaces is beautifully leveled by the use of the slurry application device 1 illustrated in FIG. 1.

Specifically, in the slurry application method according to the embodiment of the invention, the slurry application device 1 first supplies the slurry 17 to each of the front and rear surfaces of the continuously traveling steel strip 16 (a slurry supply step). In the slurry supply step, as illustrated in FIG. 4, the upper supply nozzles 21*a* to 21*c* continuously supply the slurry 17 to the front surface of the steel strip 16 traveling in a predetermined travel direction. At this time, the slurry 17 is excessively supplied to the front surface of the steel strip 16 in consideration of the slurry which is partially squeezed from the steel strip 16 by the slurry application unit 3 and the adhesion amount adjustment unit 4 at the rear stage in order to adjust the adhesion amount and the wet film thickness. In the embodiment, for example, as illustrated in FIG. 5, it is desirable that the upper supply nozzles 21*a* to 21*c* excessively supply the slurry 17 to the front surface of the steel strip 16 to a degree in which the wet film thickness Ds of the slurry 17 at the entrance side of the slurry application unit 3 becomes about 200 [μm] or more.

At the same time, the lower supply nozzles 22*a* to 22*c* illustrated in FIG. 1 continuously supply the slurry 17 to the rear surface of the traveling steel strip 16. At this time, similarly to the upper supply nozzles 21*a* to 21*c*, the lower supply nozzles 22*a* to 22*c* excessively supply the slurry 17 onto the rear surface of the steel strip 16 (for example, to a degree in which the wet film thickness Ds becomes about 200 [μm] or more) in consideration of the slurry 17 partially squeezed from the steel strip 16 by the slurry application unit 3 and the adhesion amount adjustment unit 4 at the rear stage.

The steel strip 16 which receives the slurry 17 onto each of the front and rear surfaces in the slurry supply step sequentially travels to enter the slurry application unit 3. The slurry application unit 3 applies the slurry 17 onto each of the front and rear surfaces of the steel strip 16 subjected to the slurry supply step and adjusts the adhesion amount of the slurry 17 adhering onto each of the front and rear surfaces by the application process (a slurry application step).

In the slurry application step, the slurry application unit 3 presses the rubber roll 31 against the slurry 17 supplied to the front surface of the steel strip 16. Here, as illustrated in FIG. 1, the rubber roll 31 is an upper roll body which is disposed at the downstream side in the travel direction of the steel strip 16 in relation to the slurry supply unit 2. As illustrated in FIG. 4, the rubber roll 31 presses the slurry 17 on the front surface of the steel strip 16 while rotating about the roll shaft CL1. At this time, the rotation direction of the rubber roll 31 is the same as the travel direction of the steel strip 16 at the contact portion of the rubber roll 31 with respect to the slurry 17 on the front surface of the steel strip 16. By such a rotating action and a pressing action, the rubber roll 31 applies the slurry 17 onto the front surface of the steel strip 16 and squeezes the extra amount of the slurry 17 from the front surface of the steel strip 16 to adjust the front surface adhesion amount of the slurry 17.

Specifically, as illustrated in FIG. 5, the rubber roll 31 reduces the wet film thickness Ds of the slurry 17 supplied to the front surface of the steel strip 16 to the wet film thickness Da after the application process when the extra amount of the slurry 17 is squeezed. The rubber roll 31 adjusts the front surface adhesion amount of the slurry 17 such that the wet film thickness Da of the slurry 17 on the front surface of the steel strip 16 becomes one time or more and two times or less of the target film thickness.

Also, the slurry application unit 3 presses the rubber roll 32 (see FIG. 1) serving as the lower roll body disposed at the downstream side in the travel direction of the steel strip 16 in relation to the slurry supply unit 2 against the slurry 17 supplied to the rear surface of the steel strip 16 by the slurry supply unit 2. The rubber roll 32 presses the slurry 17 on the rear surface of the steel strip 16 while rotating about the roll shaft thereof similarly to the rubber roll 31 illustrated in FIG. 4. At this time, the rotation direction of the rubber roll 32 is the same as the travel direction of the steel strip 16 at the contact portion of the rubber roll 32 with respect to the slurry 17 on the rear surface of the steel strip 16. By such a rotating action and a pressing action, the rubber roll 32 applies the slurry 17 to the rear surface of the steel strip 16 and squeezes the extra amount of the slurry 17 from the rear surface of the steel strip 16 to adjust the rear surface adhesion amount of the slurry 17.

Specifically, as illustrated in FIG. 5, the rubber roll 32 reduces the wet film thickness Ds of the slurry 17 supplied to the rear surface of the steel strip 16 to the wet film thickness Da after the application process when the extra amount of the slurry 17 is squeezed. The rubber roll 32 adjusts the rear surface adhesion amount of the slurry 17 such that the wet film thickness Da of the slurry 17 on the rear surface of the steel strip 16 becomes one time or more and two times or less of the target film thickness.

The steel strip 16 which receives the slurry 17 on each of the front and rear surfaces by the slurry application step sequentially travels to enter the adhesion amount adjustment unit 4. The adhesion amount adjustment unit 4 finishes the application of the slurry 17 onto each of the front and rear surfaces of the steel strip 16 after the slurry application step and finally adjusts the adhesion amount of the slurry 17 on each of the front and rear surfaces of the steel strip 16 (a slurry adhesion amount adjustment step).

In the slurry adhesion amount adjustment step, the adhesion amount adjustment unit 4 presses the groove attachment rubber roll 41 against the slurry 17 applied onto the front surface of the steel strip 16 by the rubber roll 31 of the slurry application unit 3. Here, as illustrated in FIG. 1, the groove attachment rubber roll 41 is the upper roll body which is disposed at the downstream side in the travel direction of the steel strip 16 in relation to the rubber roll 31 of the slurry application unit 3. Further, as illustrated in FIG. 4, the outer circumferential surface of the groove attachment rubber roll 41 is provided with the plurality of grooves 43 arranged in the material width direction of the steel strip 16 and inclined to form a roll groove angle α (see FIG. 3) of 15[°] or more and 75[°] or less with respect to the travel direction of the steel strip 16.

As illustrated in FIG. 4, the groove attachment rubber roll 41 presses the outer circumferential surface having the plurality of grooves 43 against the slurry 17 on the front surface of the steel strip 16 while rotating about the roll shaft CL2 to press the slurry 17 on the front surface. At this time, the rotation direction of the groove attachment rubber roll 41 is the same as the travel direction of the steel strip 16 at the contact portion of the groove attachment rubber roll 41 with respect to the slurry 17 on the front surface of the steel strip 16. By such a rotating action and a pressing action, the groove attachment rubber roll 41 finishes the application of the slurry 17 on the front surface of the steel strip 16 and causes the liquid meniscus of the slurry 17 between the front surface of the steel strip 16 and the groove attachment rubber roll 41 to flow along the plurality of grooves 43. Accordingly, the groove attachment rubber roll 41 squeezes the bubbles inside the slurry 17 and the extra amount of the front surface adhesion amount of the slurry 17 from the front surface of the steel strip 16. In this way, as illustrated in FIG. 5, the groove attachment rubber roll 41 adjusts the wet film thickness Da of the slurry 17 applied on the front surface of the steel strip 16 to the final wet film thickness Db. The groove attachment rubber roll 41 finally adjusts the front surface adhesion amount of the slurry 17 such that the final wet film thickness Db of the slurry 17 becomes the target film thickness.

Also, the adhesion amount adjustment unit 4 presses the groove attachment rubber roll 42 (see FIG. 1) serving as the lower roll body disposed at the downstream side in the travel direction of the steel strip 16 in relation to the rubber roll 32 against the slurry 17 applied on the rear surface of the steel strip 16 by the rubber roll 32 of the slurry application unit 3. Similarly to the groove attachment rubber roll 41 illustrated in FIG. 4, the outer circumferential surface of the groove attachment rubber roll 42 is provided with a plurality of grooves (not illustrated) arranged in the material width direction of the steel strip 16 and inclined to form a roll groove angle $\alpha$ of 15[°] or more and 75[°] or less with respect to the travel direction of the steel strip 16.

Similarly to the groove attachment rubber roll 41 illustrated in FIG. 4, the groove attachment rubber roll 42 presses the outer circumferential surface provided with the plurality of grooves against the slurry 17 on the rear surface of the steel strip 16 while rotating about the roll shaft thereof to press the slurry 17 on the rear surface. At this time, the rotation direction of the groove attachment rubber roll 42 is the same as the travel direction of the steel strip 16 at the contact portion of the groove attachment rubber roll 42 with respect to the slurry 17 on the rear surface of the steel strip 16. By such a rotating action and a pressing action, the groove attachment rubber roll 42 finishes the application of the slurry 17 on the rear surface of the steel strip 16 and causes the liquid meniscus of the slurry 17 between the rear surface of the steel strip 16 and the groove attachment rubber roll 42 along the plurality of grooves of the outer circumferential surface. Accordingly, the groove attachment rubber roll 42 squeezes the bubbles inside the slurry 17 and the extra amount of the rear surface adhesion amount of the slurry 17 from the rear surface of the steel strip 16. In this way, as illustrated in FIG. 5, the groove attachment rubber roll 42 adjusts the wet film thickness Da of the slurry 17 applied on the rear surface of the steel strip 16 to the final wet film thickness Db. The groove attachment rubber roll 42 finally adjusts the rear surface adhesion amount of the slurry 17 such that the final wet film thickness Db of the slurry 17 becomes the target film thickness.

The steel strip 16 of which the adhesion amount and the final wet film thickness of the slurry 17 on each of the front and rear surfaces are adjusted by the slurry adhesion amount adjustment step sequentially travels to enter the gas ejection unit 5. The gas ejection unit 5 ejects a gas to the slurry 17 of each of the front and rear surfaces of the steel strip 16 after the adhesion amount is adjusted by the slurry adhesion amount adjustment step such that the outer surface of the slurry 17 of each of the front and rear surfaces is leveled while the adhesion amount of the slurry 17 of each of the front and rear surfaces of the steel strip 16 is not changed (a gas ejection step).

In the gas ejection step, as illustrated in FIGS. 4 and 5, the upper gas ejection nozzle 51 of the gas ejection unit 5 ejects a gas from the ejection opening 51*a* to the slurry 17 (the slurry 17 on the front surface of the steel strip 16) of which the front surface adhesion amount is finally adjusted by the groove attachment rubber roll 41. Accordingly, the upper gas ejection nozzle 51 levels the outer surface of the slurry 17 on the front surface while not changing the finally adjusted front surface adhesion amount of the slurry 17, that is, the final wet film thickness Db of the slurry 17 on the front surface of the steel strip 16. As a result, the upper gas ejection nozzle 51 beautifully finishes an appearance of the slurry 17 forming the film on the front surface of the steel strip 16.

Also, as illustrated in FIG. 5, the lower gas ejection nozzle 52 of the gas ejection unit 5 ejects a gas to the slurry 17 (the slurry 17 on the rear surface of the steel strip 16) of which the rear surface adhesion amount is finally adjusted by the groove attachment rubber roll 42. Accordingly, the lower gas ejection nozzle 52 levels the outer surface of the slurry 17 on the rear surface while not changing the finally adjusted rear surface adhesion amount of the slurry 17, that is, the final wet film thickness Db of the slurry 17 on the rear surface of the steel strip 16. As a result, the lower gas ejection nozzle 52 beautifully finishes an appearance of the slurry 17 forming the film on the rear surface of the steel strip 16.

In the slurry application method according to the embodiment of the invention, the slurry application device 1 sequentially and repeatedly performs the slurry supply step, the slurry application step, the slurry adhesion amount adjustment step, and the gas ejection step on each of the front and rear surfaces of the continuously traveling steel strip 16. Accordingly, the slurry application device 1 can beautifully form the film of the slurry 17 having a uniform final wet film thickness Db in the material width direction and substantially equal to the target film thickness on each of the front and rear surfaces of the steel strip 16 in an entire area in the longitudinal direction of the steel strip 16.

Here, in the slurry application method, the wet film thickness Da of the slurry 17 is adjusted to one time or more and two times or less of the target film thickness by the rubber rolls 31 and 32 of the slurry application unit 3. Further, the final wet film thickness Db of the slurry 17 is adjusted to be equal to the target film thickness by the groove attachment rubber rolls 41 and 42 of the adhesion amount adjustment unit 4. That is, the wet film thickness Da of the slurry 17 is adjusted to one time or more and two times or less of the final wet film thickness Db at the entrance side of the groove attachment rubber rolls 41 and 42 of the adhesion amount adjustment unit 4.

Since the wet film thickness Da of the slurry 17 is adjusted to one time or more and two times or less of the final wet film thickness Db, the liquid amount of the slurry 17 entering the groove attachment rubber rolls 41 and 42 of the adhesion amount adjustment unit 4 can be reduced to a minimal amount necessary for the final adjustment of the adhesion amount of the slurry 17. That is, the liquid amount of the slurry 17 squeezed by the groove attachment rubber rolls 41 and 42 can be reduced to a necessary minimal amount. Accordingly, it is possible to reduce the amount of the liquid meniscus of the slurry 17 between each of the groove attachment rubber rolls 41 and 42 and each of the front and rear surfaces of the steel strip 16 (between the roll and the base material) as much as possible. As a result, since it is possible to suppress a problem in which a change in fluid pressure of the liquid meniscus of the slurry 17 between the roll and the base material exceeds a surface tension stabilization effect, it is possible to suppress a stripe pattern (a stripe-shaped appearance defect such as ribbing) generated in the slurry 17 caused by this problem. Further, it is possible to suppress a problem of a bold stripe-shaped appearance defect of the slurry 17 caused by large bubbles entering the slurry 17 when the adhesion amount of the slurry 17 is adjusted. With the above-described configuration, it is possible to obtain a beautiful and uniform appearance of the film of the slurry 17 formed on each of the front and rear surfaces of the steel strip 16.

On the contrary, in a case where the adhesion amount of the applied slurry 17 is adjusted to an excessively large adhesion amount in which the wet film thickness Da is larger than two times of the final wet film thickness Db, the amount of the liquid meniscus of the slurry 17 between the roll and the base material excessively increases. As a result, since a change in fluid pressure of the liquid meniscus between the roll and the base material undesirably occurs, a stripe shape (a stripe-shaped appearance defect) occurs in the slurry 17. Further, in a case where the adhesion amount of the applied slurry 17 is adjusted to an excessively small adhesion amount in which the wet film thickness Da is smaller than one time of the final wet film thickness Db, a portion in which the adhesion amount of the slurry 17 cannot be sufficiently adjusted by the groove attachment rubber rolls 41 and 42 occurs in each of the front and rear surfaces of the steel strip 16. A stripe-shaped unevenness unevenness in application) of the slurry 17 occurs at the portion of the steel strip 16.

Meanwhile, the outer surfaces of the groove attachment rubber rolls 41 and 42 of the adhesion amount adjustment unit 4 are provided with a plurality of oblique grooves which are inclined with respect to the travel direction of the steel strip 16 similarly to the grooves 43 illustrated in FIG. 3 and the like. Here, in a case where the plurality of grooves formed in the outer surfaces of the groove attachment rubber rolls 41 and 42 are grooves formed in the same direction as the travel direction of the steel strip 16, bubbles stay at the liquid meniscus of the slurry 17 in the final adjustment of the adhesion amount of the slurry 17 due to the groove attachment rubber rolls 41 and 42. Accordingly, a stripe-shaped appearance defect easily occurs in the slurry 17 of which the adhesion amount is finally adjusted. Such a stripe-shaped appearance defect also easily occurs even in a case where the plurality of grooves of the outer surfaces of the groove attachment rubber rolls 41 and 42 are grooves formed in a direction perpendicular to the travel direction of the steel strip 16.

On the contrary, in a case where the plurality of grooves of the outer surfaces of the groove attachment rubber rolls 41 and 42 are inclined with respect to the travel direction of the steel strip 16, the liquid meniscus of the slurry 17 between the roll and the base material flows in the material width direction in accordance with the rotation of the groove attachment rubber rolls 41 and 42 in the outer circumferential direction. For this reason, the groove attachment rubber rolls 41 and 42 can efficiently squeeze the bubbles inside the slurry 17 to the outside of the steel strip 16 when the adhesion amount of the slurry 17 is finally adjusted. As a result, it is possible to suppress a stripe-shaped appearance defect occurring in the slurry 17 of which the adhesion amount is finally adjusted.

It is desirable that the roll groove angle α (see FIG. 3) formed between each of the grooves of the outer surfaces of the groove attachment rubber rolls 41 and 42 and the travel direction of the steel strip 16 be 15[°] or more and 75[°] or less from the viewpoint of efficiently removing the bubbles inside the slurry 17. This is because of the following reasons. That is, in a case where the roll groove angle α is a small angle (smaller than 15 [°]) or a large angle (larger than 75 [°]) with respect to the travel direction of the steel strip 16, the liquid meniscus of the slurry 17 cannot sufficiently flow along the plurality of grooves of the outer circumferential surfaces of the groove attachment rubber rolls 41 and 42. Accordingly, it is difficult to efficiently remove the bubbles from the slurry 17.

Meanwhile, as described above, the rotation directions of the rubber rolls 31 and 32 and the groove attachment rubber rolls 41 and 42 squeezing the extra amount of the slurry 17 from the steel strip 16 to adjust the adhesion amount of the slurry 17 are the same as the travel direction of the steel strip 16 at the contact portions of the rubber rolls 31 and 32 and the groove attachment rubber rolls 41 and 42 with respect to the slurries 17 on the front and rear surfaces of the steel strip 16. This is because the durabilities of the rubber rolls 31 and 32 and the groove attachment rubber rolls 41 and 42 are improved and the adhesion amount of the slurry 17 is adjusted while a stripe-shaped appearance defect is suppressed. Additionally, there is a case where the rotation directions of the rubber rolls 31 and 32 and the groove attachment rubber rolls 41 and 42 are opposite to the travel direction of the steel strip 16 at the contact portions with respect to the slurry 17 from the viewpoint of obtaining a beautiful appearance of the film of the slurry 17 and suppressing a stripe-shaped appearance defect. However, in this case, the friction forces of the rubber rolls 31 and 32 and the groove attachment rubber rolls 41 and 42 with respect to the steel strip 16 increase and thus the durabilities of the rubber rolls 31 and 32 and the groove attachment rubber rolls 41 and 42 are shortened. For this reason, this configuration is not desirable.

EXAMPLES 1 TO 10 AND COMPARATIVE EXAMPLES 1 TO 4

Next, Examples 1 to 10 of the invention will be described in detail while being compared with Comparative Examples 1 to 4. In Examples 1 to 10, the steel strip 16 (the base material) of the treatment target was set as a belt-shaped steel plate having a plate thickness of 0.3 [mm] and a plate width of 1160 [mm]. The slurry 17 applied onto the steel strip 16 was obtained by mixing water with powder of magnesium oxide (MgO) and a concentration of a solid content of the slurry 17 was adjusted to 5 [vol %].

Further, in Examples 1 to 10, the slurry application device 1 illustrated in FIG. 1 was used as a device applying the slurry 17 to the steel strip 16. In the slurry application device 1, the slurry supply unit 2 was formed such that the ejection openings (circular holes) of the spray nozzles ejecting the slurry 17 were arranged at a pitch of 100 [mm] in the material width direction. A diameter of the ejection opening of the spray nozzle was set to 6 [mm]. Further, the rubber rolls 31 and 32 of the slurry application unit 3 were formed as rubber rolls obtained by lining rubber on a metal roll. In the rubber rolls 31 and 32, a rubber lining thickness was set to 20 [mm], rubber was set as urethane rubber having a hardness Hs55° (Shore A55), and a roll diameter was set to 150 [mm]. The groove attachment rubber rolls 41 and 42 of the adhesion amount adjustment unit 4 were obtained by forming a plurality of grooves at the outer circumferential surface of the rubber roll having the same configuration as those of the rubber rolls 31 and 32. The plurality of grooves were set as V-shaped grooves each having a depth of 0.3 [mm] and were arranged at a pitch of 0.5 [mm] in the width direction of the groove attachment rubber rolls 41 and 42. Meanwhile, the upper gas ejection nozzle 51 and the lower gas ejection nozzle 52 of the gas ejection unit 5 were set as slit nozzles of which a slit gap of ejection openings was 1 [mm].

Such a slurry application device 1 performed a process of applying the slurry 17 onto each of the front and rear surfaces of the continuously traveling steel strip 16 by appropriately changing conditions of the roll groove angle α, the wet film thickness Da of the applied slurry 17, the final wet film thickness Db of the slurry 17 after the final adjustment of the adhesion amount, and the gas ejection state of each of Examples 1 to 10. At this time, the rotation directions of the rubber rolls 31 and 32 and the groove attachment rubber rolls 41 and 42 were set to be the same as the travel direction of the steel strip 16 at the contact portions with respect to the slurries 17 on the front and rear surfaces of the steel strip 16 similarly to the slurry application method according to the above-described embodiment. The line speed of the steel strip 16 was set to 50 [m/min].

Further, the adhesion amount of the slurry 17 adhering to the steel strip 16 by the application process was checked in such a manner that the intensity of fluorescent X rays of a film (a film obtained by drying the slurry 17) of a sample cut out from the steel strip 16 obtained after drying the slurry 17 were measured and the measurement result was compared with a predetermined calibration curve. The calibration curve was prepared on the basis of a correlation between an adhesion weight and the intensity of fluorescent X rays of a film after the intensity of the fluorescent X rays of the film was measured from the sample of the steel strip 16 obtained after forming a film (specifically, a MgO film) by drying the slurry 17 and a difference between a mass of the sample and a mass of the sample obtained by wiping the film was measured as the adhesion weight of the film. During the measurement of the intensity of the fluorescent X rays, a mask diameter was set to 20 [mm], an acceleration voltage was set to 45 [kV], an acceleration current was set to 50 [mA], and a measurement time was set to 20 seconds.

Meanwhile, in Comparative Examples 1 and 2 of Comparative Examples 1 to 4 as comparison targets of Examples 1 to 10, a process of applying the slurry 17 was performed in a state where the conditions of the roll groove angle α, the wet film thickness Da, the final wet film thickness Db, and the gas ejection state were set to be different from those of Examples 1 to 10 and the other conditions were set to be the same as those of Examples 1 to 10.

Figure 6:
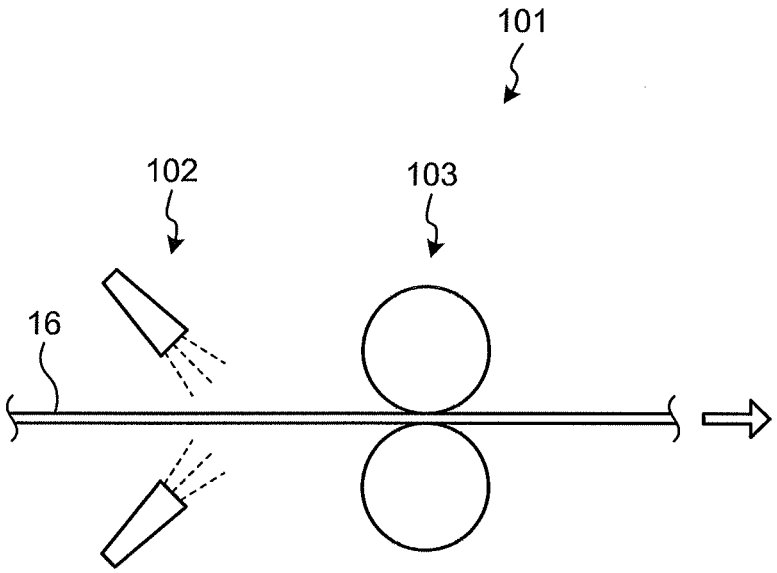
FIG. 6 is a diagram illustrating an example of a conventional slurry application device.
Figure 7:
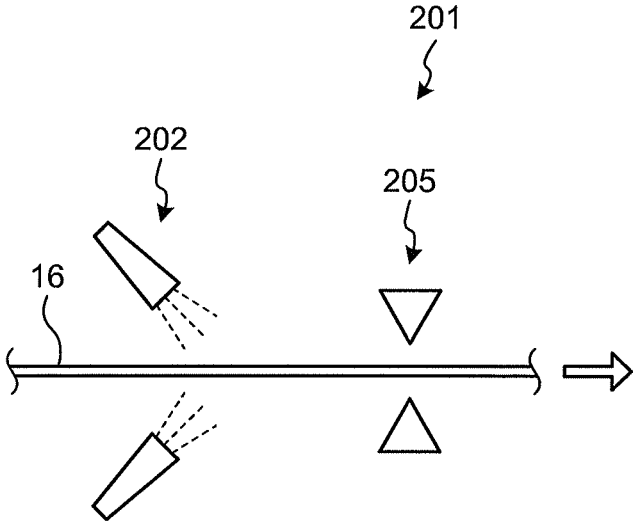
FIG. 7 is a diagram illustrating another example of a conventional slurry application device.

In Comparative Examples 3 and 4, a process of applying the slurry 17 onto the steel strip 16 was performed by an application type different from those of Examples 1 to 10. FIG. 6 is a diagram illustrating an example of a conventional slurry application device. FIG. 7 is a diagram illustrating another example of a conventional slurry application device. A slurry application device 101 of FIG. 6 is a conventional roll applicator type device including a slurry supply unit 102 which supplies slurry to each of the front and rear surfaces of the steel strip 16 and a slurry application unit 103 which serves as a single roll applicator applying slurry onto each of the front and rear surfaces of the steel strip 16 and finally adjusting a slurry adhesion amount. A slurry application device 201 illustrated in FIG. 7 is a conventional applicator type (hereinafter, referred to as a gas ejection type) device including a slurry supply unit 202 which supplies slurry to each of the front and rear surfaces of the steel strip 16 and a gas ejection unit 205 which applies slurry onto each of the front and rear surfaces of the steel strip 16 and finally adjusts a slurry adhesion amount by ejecting a gas thereto.

In Comparative Example 3, the slurry application device 101 illustrated in FIG. 6 performs a process of applying the slurry 17 onto each of the front and rear surfaces of the steel strip 16 by a conventional roll applicator type (a single layer roll applicator type) using a single roll applicator. In Comparative Example 4, the slurry application device 201 illustrated in FIG. 7 performs a process of applying the slurry 17 onto each of the front and rear surfaces of the steel strip 16 by the conventional gas ejection type. Additionally, the conditions of Comparative Examples 3 and 4 were set to be the same as those of Examples 1 to 10 except for the conditions of the application type, the roll groove angle α, the wet film thickness Da, the final wet film thickness Db, and the gas ejection state.

The slurry 17 formed after the application process of each of Examples 1 to 10 and Comparative Examples 1 to 4 was dried in such a manner that air of 350[° C.] was ejected by a hot air drying furnace in order to raise a temperature to 150[° C.] at a temperature increase speed of 10[° C./second]. In Examples 1 to 10 and Comparative Examples 1 to 4, an application appearance evaluation of the slurry 17 on each of the front and rear surfaces of the steel strip 16 was performed as described above in such a manner that a sample was cut out from the steel strip 16 obtained by drying the slurry 17 and an appearance of the slurry 17 on the sample surface was observed under a sufficiently bright fluorescent light. Table 1 illustrates an application appearance evaluation result of the slurry 17 of each of Examples 1 to 10 and Comparative Example 1 to 4.

TABLE 1

| | Applicator type | Roll groove angle α [°] | Wet film thickness Da [μm] | Final wet film thickness (target value) Db [μm] | Film thickness ratio Da/Db [—] | Gas ejection | Appearance evaluation |
|---|---|---|---|---|---|---|---|
| Example 1 | Type A | 0 | 50 | 50 | 1.0 | No | ○ |
| Example 2 | Type A | 0 | 70 | 50 | 1.4 | No | ○ |
| Example 3 | Type A | 0 | 100 | 50 | 2.0 | No | ○ |
| Example 4 | Type A | 10 | 70 | 50 | 1.4 | No | ○ |
| Example 5 | Type A | 20 | 70 | 50 | 1.4 | No | ⊙ |
| Example 6 | Type A | 45 | 70 | 50 | 1.4 | No | ⊙ |
| Example 7 | Type A | 70 | 70 | 50 | 1.4 | No | ⊙ |
| Example 8 | Type A | 80 | 70 | 50 | 1.4 | No | ○ |
| Example 9 | Type A | 10 | 70 | 50 | 1.4 | Yes | ⊙ |
| Example 10 | Type A | 80 | 70 | 50 | 1.4 | Yes | ⊙ |
| Comparative Example 1 | Type A | 0 | 40 | 50 | 0.8 | No | x |
| Comparative Example 2 | Type A | 0 | 120 | 50 | 2.4 | No | x |
| Comparative | Type B | 0 | — | 50 | — | No | x |

TABLE 1-continued

| | Applicator type | Roll groove angle α [°] | Wet film thickness Da [μm] | Final wet film thickness (target value) Db [μm] | Film thickness ratio Da/Db [—] | Gas ejection | Appearance evaluation |
|---|---|---|---|---|---|---|---|
| 3 Comparative 4 | Type C | — | — | 50 | — | Yes | x |

In Table 1, Types A, B, and C of an application type section respectively indicate a type of applying the slurry 17 onto the steel strip 16. Specifically, Type A indicates a slurry application type including a two-stage roll applicator type using the slurry application device 1 according to the embodiment of the invention. Type B indicates a slurry application type including a single stage of the roll applicator type using the conventional slurry application device 101. Type C indicates a slurry application type including a conventional gas ejection type using the conventional slurry application device 201.

The final wet film thickness Db is a value obtained by a back calculation using a concentration of a solid content of the slurry 17 and an adhesion weight of a film (a MgO film) obtained by drying the slurry 17. In Examples 1 to 10 and Comparative Examples 1 to 4, a target value (a target film thickness) of the final wet film thickness Db was set to 50 [μm]. The wet film thickness Da is a value obtained by measuring an adhesion weight of a film (a MgO film) obtained by drying the slurry 17 from which an extra amount is squeezed by the rubber rolls 31 and 32 of the slurry application unit 3 serving as the front-stage rolls of the two-stage roll applicator and performing a back calculation using the measurement value and the concentration of the solid content of the slurry 17. Additionally, the slurry 17 from which an extra amount is squeezed by the rubber rolls 31 and 32 can be obtained by opening the groove attachment rubber rolls 41 and 42 of the adhesion amount adjustment unit 4 serving as the rear-stage rolls of the two-stage roll applicator during the process of applying the slurry 17 in the slurry application device 1.

A film thickness ratio Da/Db is a ratio of the wet film thickness Da with respect to the final wet film thickness Db. In a gas ejection section, "Yes" indicates a state where a gas is ejected to the slurries 17 on the front and rear surfaces of the steel strip 16 and "No" indicates a state where a gas is not ejected to the slurries 17 on the front and rear surfaces of the steel strip 16.

Further, in Table 1, marks of "⊙", "○", and "×" in an appearance evaluation section indicate an application appearance evaluation result of the slurry 17 on each of the front and rear surfaces of the steel strip 16. Specifically, Mark ⊙ indicates an extremely satisfactory state where an appearance defect such as an unevenness in application and a stripe-shaped application defect does not occur in the slurry 17 and a beautiful and smooth film of the slurry 17 is obtained. Mark ○ indicates a satisfactory state where a slightly stripe shape which is not visually recognized is formed at the slurry 17, but a film having an appearance satisfying a product standard is obtained. Mark × indicates a poor state where an appearance defect such as spots caused by the scattering of slurry, a stripe-shaped application defect, or unevenness in application occurs on the substantially entire surface of the slurry 17 and an appearance of a film does not satisfy a product standard.

As understood by referring to Table 1, in Examples 1 to 10 of the invention, since the adhesion amount of the slurry 17 was adjusted while the extra amount of the slurry 17 was squeezed from the steel strip 16 such that the film thickness ratio Da/Db became one time or more and two times or less by the two-stage roll applicator type including the front-stage slurry application unit 3 and the rear-stage adhesion amount adjustment unit 4, the slurry 17 could be smoothly and uniformly applied onto each of the front and rear surfaces of the steel strip 16 and thus a satisfactory appearance of the slurry 17 could be obtained after the application process and the adhesion amount adjustment process. In particular, as illustrated in Examples 5 to 7, since the roll groove angle α of each of grooves of the outer circumferential surfaces of the groove attachment rubber rolls 41 and 42 was set to 15[° ] or more and 75[°] or less, a more beautiful appearance of the slurry 17 could be obtained. Further, as illustrated in Examples 9 and 10, since a gas was ejected from the gas ejection unit 5 (see FIG. 1) to the slurry 17 of which the adhesion amount was finally adjusted, the outer surface of the slurry 17 is appropriately leveled. As a result, a more beautiful appearance of the slurry 17 could be obtained.

On the contrary, as illustrated in Comparative Examples 1 and 2, in a case where the film thickness ratio Da/Db during the process of applying the slurry 17 was smaller than one time or larger than two times, an appearance defect such as an unevenness in application (an unevenness in a coating film), spots caused by the scattering of slurry, and a stripe-shaped application defect caused by remaining bubbles occurred in the slurry 17. As a result, the slurry 17 could not be uniformly applied and a satisfactory application appearance of the slurry 17 could not be obtained. Further, even in a case where a slurry application process and an extra slurry squeezing process were performed by a single stage of the roll applicator type as illustrated in Comparative Example 3 or a case where the adhesion amount of the slurry 17 was finally adjusted by a gas ejection type as illustrated in Comparative Example 4, an appearance defect occurred in the slurry 17 similarly to Comparative Examples 1 and 2. Also, the slurry 17 could not be uniformly applied and a satisfactory application appearance of the slurry 17 could not be obtained.

As described above, in the embodiment of the invention, slurry is supplied from the slurry supply unit onto the surface of the traveling base material, the first roll body disposed at the downstream side in the base material travel direction in relation to the slurry supply unit is pressed against the slurry supplied to the surface of the base material to apply the slurry onto the surface of the base material and to adjust the slurry adhesion amount of the surface of the base material such that the wet film thickness of the slurry of the surface of the base material becomes one time or more and two times or less of the target film thickness, and the second roll body disposed at the downstream side in the base material travel direction in relation to the first roll body is pressed against the slurry applied onto the surface of the base material to adjust the slurry adhesion amount such that the final wet film thickness of the slurry of the surface of the base material becomes the target film thickness.

For this reason, the slurry can be applied and widened in the material width direction of the traveling base material by using the first roll body at the front stage and the second roll body at the rear stage arranged in the base material travel direction. At the same time, the extra amount of the slurry of the surface of the base material is appropriately squeezed from the surface of the base material by the first roll body such that the slurry adhesion amount before the final adjustment of the second roll body decreases to the minimal adhesion amount necessary for the final adjustment. Further, the slurry adhesion amount obtained after decreasing the adhesion amount can be finally adjusted to the target adhesion amount by the second roll body. With the above-described configuration, since it is possible to apply the slurry onto the surface of the base material while suppressing an unevenness in application of the slurry in an entire area in the longitudinal direction and the material width direction of the base material and to decrease the amount of the liquid meniscus of the slurry existing between the surface of the base material and the outer circumferential surface of the second roll body to a necessary minimal amount, it is possible to suppress a stripe-shaped application defect caused by a change in fluid pressure of the liquid meniscus. As a result, it is possible to form a uniform film (a uniform coating film) of the slurry on the surface of the base material in the entire length of the base material without causing the scattering of the slurry in the conventional method of finally adjusting the slurry adhesion amount by the ejection of a gas and to ensure a beautiful appearance of the film of the slurry while suppressing an appearance defect in the film of the slurry of the surface of the base material.

Further, in the embodiment of the invention, the groove attachment rubber roll of which the outer circumferential surface is provided with a plurality of grooves inclined with respect to the base material travel direction and arranged in the width direction of the base material is used as the second roll body and the outer circumferential surface of the groove attachment rubber roll is pressed against the slurry of the surface of the base material to adjust the slurry adhesion amount. For this reason, it is possible to cause the liquid meniscus of the slurry existing between the surface of the base material and the outer circumferential surface of the groove attachment rubber roll to flow to the outside of the surface of the base material along the plurality of grooves in accordance with the rotation of the groove attachment rubber roll in the outer circumferential direction. As a result, since it is possible to efficiently remove the bubbles inside the slurry to the outside of the surface of the base material when the slurry adhesion amount is finally adjusted by the groove attachment rubber roll, it is possible to suppress a stripe-shaped application defect (an appearance defect) in the slurry of which the adhesion amount is finally adjusted as much as possible.

Further, in the embodiment of the invention, the roll groove angle $\alpha$ (see FIG. 3) formed between the base material travel direction and each of the grooves formed in the outer circumferential surface of the groove attachment rubber roll is set to 15[°] or more and 75[°] or less. As a result, since it is possible to further efficiently remove the bubbles inside the slurry along the plurality of grooves, it is possible to further suppress a problem in which a stripe-shaped application defect occurs in the slurry.

Further, in the embodiment of the invention, the rotation directions of the first roll body and the second roll body are set to be the same as the base material travel direction at the contact portions of the first roll body and the second roll body with respect to the slurry of the surface of the base material. Accordingly, it is possible to adjust the slurry adhesion amount while suppressing a stripe-shaped appearance defect by the first roll body and the second roll body and to reduce a friction force between each of the first roll body and the second roll body and the surface of the base material. As a result, since it is possible to improve the durabilities of the first roll body and the second roll body, it is possible to reduce a cost and the number of maintenances (for example, the number of replacements) necessary for the first roll body and the second roll body.

Further, in the embodiment of the invention, the outer surface of the slurry is leveled without any change in slurry adhesion amount in such a manner that a gas is ejected to the slurry of which the adhesion amount is finally adjusted by the second roll body. Accordingly, since it is possible to smoothen the outer surface of the slurry without scattering the slurry of the surface of the base material, it is possible to maintain a more beautiful appearance of the film (the film) of the slurry of the surface of the base material.

Additionally, in the above-described embodiment, the slurry 17 is applied onto each of the front and rear surfaces of the steel strip 16 as an example of the base material of the treatment target, but the invention is not limited thereto. The slurry application device and the slurry application method according to aspects of the invention may be used to apply the slurry 17 to at least one of the front surface and the rear surface of the steel strip 16.

Further, in the above-described embodiment, the slurry supply unit 2 includes three spray nozzles arranged in the material width direction of the steel strip 16, but the invention is not limited thereto. The arrangement positions and the arrangement number of the spray nozzles constituting the slurry supply unit 2 can be arbitrarily set and are not particularly limited in the invention. Alternatively, the slurry supply unit 2 is not limited to a configuration in which the spray nozzles are arranged. For example, the spraying openings or the ejection openings of the slurry 17 may be arranged in the material width direction while the material width direction is set as the longitudinal direction.

Further, in the above-described embodiment, the slurry application unit 3 disposed at the rear stage of the slurry supply unit 2 includes the rubber rolls 31 and 32, but the invention is not limited thereto. The roll body (the first roll body) constituting the slurry application unit 3 is not limited to the rubber roll body, but may be a metal or resin roll body other than the rubber roll body. Further, the roll body may be formed of an appropriate combination of these materials. That is, in accordance with aspects of the invention, the material of the first roll body is not particularly limited. Further, the number of the first roll bodies, the number of stages thereof, and the arrangement shape thereof in the slurry application unit 3 can be arbitrarily set and are not particularly limited in the invention.

Further, in the above-described embodiment, the adhesion amount adjustment unit 4 disposed at the rear stage of the slurry application unit 3 includes the groove attachment rubber rolls 41 and 42, but the invention is not limited thereto. The roll body (the second roll body) constituting the adhesion amount adjustment unit 4 is not limited to the rubber roll body of which the outer circumferential surface is provided with a plurality of grooves, but may be a metal or resin roll body other than the rubber roll body. For example, the roll body may be formed of an appropriate combination of these materials. That is, in accordance with aspects of the invention, the material of the second roll body is not particularly limited. Further, the number of the second roll bodies, the number of stages thereof, and the arrangement shape thereof in the adhesion amount adjustment unit 4 can be arbitrarily set and are not particularly limited in the invention. Additionally, the second roll body may be a groove attachment roll body of which an outer circumferential surface is provided with one or more grooves or may be a roll body of which an outer circumferential surface is not provided with a groove.

Further, in the above-described embodiment, aspects of the invention have been described by exemplifying the steel strip 16 as an example of the base material of the treatment target, but the invention is not limited thereto. The base material which is treated by the slurry application device and the slurry application method according to aspects of the invention is not limited to the steel strip (the belt-shaped steel plate), but may be a belt-shaped body of iron alloy other than steel, a belt-shaped body of copper or aluminum other than iron alloy, or a belt-shaped body of paper or a resin film other than metal. In this case, the slurry 17 applied onto the surface of the base material is not limited to the slurry including solid particles of a ceramics element such as magnesium oxide, but may be any one which is selected in accordance with the base material of the treatment target.

Further, the invention is not limited by the embodiment or the examples described above and an appropriate combination of the above-described configurations is also included in the invention. In addition, the other embodiments, the other examples, and the operation techniques obtained by the person skilled in the art on the basis of the embodiment or the examples described above are all included in the invention.

INDUSTRIAL APPLICABILITY

As described above, the slurry application device and the slurry application method according to aspects of the invention are useful to apply slurry onto the surface of the base material. In particular, the slurry application device and the slurry application method capable of forming a uniform film of slurry on the surface of the base material in an entire length of the base material and suppressing an appearance defect of the film of the slurry of the surface of the base material are suitably obtained.

REFERENCE SIGNS LIST

1 SLURRY APPLICATION DEVICE
2 SLURRY SUPPLY UNIT
3 SLURRY APPLICATION UNIT
4 ADHESION AMOUNT ADJUSTMENT UNIT
5 GAS EJECTION UNIT
16 STEEL STRIP
17 SLURRY
21*a*, 21*b*, 21*c* UPPER SUPPLY NOZZLE
22*a*, 22*b*, 22*c* LOWER SUPPLY NOZZLE
31, 32 RUBBER ROLL
41, 42 GROOVE ATTACHMENT RUBBER ROLL
43 GROOVE
51 UPPER GAS EJECTION NOZZLE
51*a* EJECTION OPENING
52 LOWER GAS EJECTION NOZZLE
101, 201 (CONVENTIONAL) SLURRY APPLICATION DEVICE
102, 202 SLURRY SUPPLY UNIT
103 SLURRY APPLICATION UNIT
205 GAS EJECTION UNIT
CL1, CL2 ROLL SHAFT

The invention claimed is:

1. A slurry application device comprising:

a slurry supply unit configured to supply a slurry to a surface of a traveling base material;

a slurry application unit including a first roll body disposed at the downstream side in a travel direction of the base material in relation to the slurry supply unit and configured to press the first roll body against the slurry supplied to the surface of the base material and to adjust an adhesion amount of the slurry applied on and adhering to the surface of the base material such that a film thickness of the slurry on the surface of the base material becomes one to two times of a target film thickness; and a slurry adhesion amount adjustment unit including a second roll body disposed at the downstream side in the travel direction of the base material in relation to the slurry application unit and configured to press the second roil body against the slurry applied on the surface of the base material to adjust the slurry adhesion amount such that the film thickness of the slurry on the surface of the base material becomes the target film thickness, a roll diameter of the first roll body being the same as a roll diameter of the second roll body.

2. The slurry application device according to claim 1, wherein the second roll body is a groove attachment rubber roll whose outer circumferential surface is provided with a plurality of grooves arranged in a width direction of the base material and inclined with respect to the travel direction of the base material, and wherein the groove attachment rubber roll adjusts the slurry adhesion amount in such a manner that the outer circumferential surface provided with the plurality of grooves is pressed against the slurry of the surface of the base material.

3. The slurry application device according to claim 2, wherein the plurality of grooves are formed such that an angle of 15 ° to 75 20 is formed with respect to the travel direction of the base material.

4. The slurry application device according to claim 1, wherein rotation directions of the first roll body and the second roll body are same as the travel direction of the base material at contact portions of the first roll body and the second roll body with respect to the slurry of the surface of the base material.

5. The slurry application device according to claim 1, further comprising a gas ejection unit configured to level an outer surface of the slurry without changing the slurry adhesion amount by ejecting a gas to the slurry whose adhesion amount is adjusted by the slurry adhesion amount adjustment unit.

6. A slurry application method comprising:

a slurry supply step of supplying slurry onto a surface of a traveling base material;

a slurry application step of pressing a first roll body disposed at the downstream side in a travel direction of the base material in relation to a slurry supply unit supplying the slurry against the slurry supplied to the surface of the base material to apply the slurry onto the surface of the base material and to adjust an adhesion amount of the slurry applied on and adhering to the surface of the base material such that a film thickness of the slurry on the surface of the base material becomes one to two times of a target film thickness; and a slurry adhesion amount adjustment step of pressing a second roll body disposed at the downstream side in the travel direction of the base material in relation to a slurry application unit applying the slurry against the Slurry applied on the surface of the base material to adjust the slurry adhesion amount such that the film thickness of the slurry on the surface of the base material becomes the target film thickness, a roll diameter of the first roll body being the same as a roll diameter of the second roll body.

7. The slurry application method according to claim 6, wherein the slurry adhesion amount adjustment step adjusts the slurry adhesion amount by pressing an outer circumferential surface of the second roll body serving as a groove attachment rubber roll whose outer circumferential surface is provided with a plurality of grooves arranged in a width direction of the base material and inclined with respect to the travel direction of the base material against the slurry of the surface of the base material.

8. The slurry application method according to claim 7, wherein the plurality of grooves are formed such that an angle of 15 ° to 75 ° is formed with respect to the travel direction of the base material.

9. The slurry application method according to claim 6, wherein rotation directions of the first roll body and the second roll body are same as the travel direction of the base material at contact portions of the first roll body and the second roll body with respect to the slurry of the surface of the base material.

10. The slurry application method according to claim 6, further comprising a gas ejection step of leveling an outer surface of the slurry without changing the slurry adhesion amount by ejecting a gas to the slurry of which the adhesion amount is adjusted by the slurry adhesion amount adjustment step.

* * * * *